United States Patent [19]

Fukumori et al.

[11] Patent Number: 4,591,298

[45] Date of Patent: May 27, 1986

[54] EXPANSION BEAM FOR SHORING UP SAND GUARDS

[75] Inventors: Kenichi Fukumori, Higashi; Katsumi Kamimura, Kyoto, both of Japan

[73] Assignee: Japan Speed Shore Co., Ltd., Osaka, Japan

[21] Appl. No.: 668,557

[22] Filed: Nov. 2, 1984

[30] Foreign Application Priority Data

Jun. 20, 1984 [JP] Japan ..... 59-91878[U]
Jul. 16, 1984 [JP] Japan ..... 59-107961[U]

[51] Int. Cl.[4] ..... E21D 5/00

[52] U.S. Cl. ..... 405/282; 137/614.19; 405/272

[58] Field of Search ..... 405/272, 273, 282, 284, 405/291, 302; 137/614.19, 614.11, 797

[56] References Cited

U.S. PATENT DOCUMENTS

| | | | |
|---|---|---|---|
| 2,826,218 | 3/1958 | Barlow et al. | 137/614.19 X |
| 2,905,487 | 9/1959 | Schifter | 137/614.19 X |
| 3,224,201 | 12/1965 | Brunton | 405/282 |
| 3,230,720 | 1/1966 | Bennett | 405/282 |
| 3,295,330 | 1/1967 | Meshorer | 405/282 |
| 3,335,573 | 8/1967 | Ward | 405/282 |
| 3,347,049 | 10/1967 | Faltersack et al. | 405/282 |
| 3,791,151 | 2/1974 | Plank | 405/282 |
| 3,851,856 | 12/1974 | Berg | 405/282 X |
| 4,009,729 | 3/1977 | Vik | 137/614.19 X |
| 4,527,587 | 7/1985 | Fairlamb | 137/614.19 X |

*Primary Examiner*—Dennis L. Taylor
*Attorney, Agent, or Firm*—Wenderoth, Lind & Ponack

[57] ABSTRACT

A plug of an expansion beam for shoring up sand guards is equipped with a second non-return valve. If it should happen that the head of the plug is broken off owing to, for example, a falling rock, the second non-return valve works as a safety device to prevent the expansion and contraction of the expansion beam. Thus, the shoring up function is able to be maintained.

12 Claims, 7 Drawing Figures

EXPANSION BEAM FOR SHORING UP SAND GUARDS

BACKGROUND OF THE INVENTION

1. Field of the Invention

This invention relates to sand guards for preventing the excavated face of land from collapsing and sliding and, more particularly, is concerned with an expansion beam for shoring up such sand guards.

2. Description of the Prior Art

As a beam which is utilized for shoring up sand guards, in recent years there has been used a certain kind of expansion beam. This expansion beam is chiefly made up of a piston and cylinder-type expansion device which is put into action by the aid of hydraulic liquid, is able to expand and contract, has a pair of pads attached to both ends of the expansion device, also has a plug which is attached to one of the pads, and is used for pouring the hydraulic liquid into the expansion device.

The plug is one which has within itself a non-return valve. To this plug there is connected detachably a socket of a hose extending from a pump, whereby the hydraulic liquid is poured into the expansion device until reaching a prescribed pressure. After the socket is separated from the plug, then the non-return valve functions in such a manner that the hydraulic liquid is unable to flow out from the expansion device.

However, the plug is easily damaged or broken off due to falling rock and the like while in use because of its part projecting over the pad, wherefore the non-return valve sometimes does not properly work or sometimes malfunctions with the breakage of the plug. Thus, the liquid flows out from the expansion device and the pressure therein is reduced, with the result that the expansion beam can not fulfill the function of shoring up sand guards.

The present invention is so designed that the hydraulic liquid does not flow out from the expansion device even when the plug is damaged or broken.

SUMMARY OF THE INVENTION

According to the invention, there is ordinarily used a nipple with the object of attaching the plug to the pad. Inside the connecting part of the nipple to the pad, a second non-return valve is provided. This second non-return valve inside the nipple is made to communicate with the above-mentioned valve within the plug. Further, in the connecting part of the nipple to the plug, there is provided a restraining counting device which keeps the non-return valve open under ordinary circumstances.

Since the second non-return valve is provided inside the connecting part of the nipple to the pad, even if the non-return valve inside the plug is out of order, the hydraulic liquid does not flow out because the second non-return valve is still working. In case the plug is broken and lost together with the connecting part of the nipple to the plug due to a falling rock or the like, the second non-return valve still remains together with the connecting part of the nipple to the pad, and stops the outflow of the liquid. On the other hand, as the non-return valve inside the plug is mechanically interlocked with the second non-return valve, in ordinary circumstances these two non-return valves open together if the socket is detachably connected to the plug. Further, the restraining device provided inside the connecting part of the nipple to the plug usually keeps the second non-return valve in the open position so as not to disturb the hydraulic liquid from flowing in and out when the plug is connected to the socket. When the connecting part of the nipple to the plug is broken and lost, the restraining device is released, thus allowing the second non-return valve to lie in the closed position.

DETAILED DESCRIPTION OF THE PREFERRED EMBODIMENTS

Figure 1:
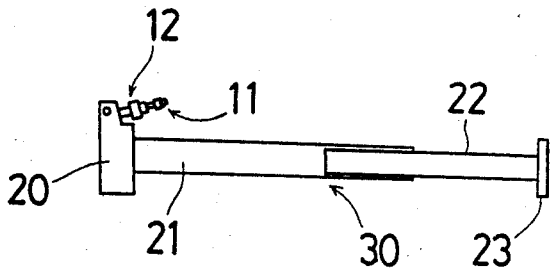
FIG. 1 is a schematic drawing of an expansion beam for shoring up sand guards.

The present invention will be described with reference to the accompanying drawings.

Initially, the expansion beam for shoring up sand guards will be explained while referring to FIGS. 1 and 2. This expansion beam (30) for shoring up sand guards is made up of a piston and cylinder-type expansion device which has a cylinder (21) and a piston rod (22) in a telescopic form. To the respective free ends of the cylinder (21) and the piston rod (22), there are attached their own pads (20), (23). A plug (11) is attached to the pad (20) through the medium of a nipple (12). The hydraulic liquid which is forced under pressure into this plug (11) goes into the cylinder (21) via a passage (24). Since the plug (11) is provided with a non-return valve, if the inward forces opposite to each other are applied to the expansion beam (30) at the pads (20), (23), the liquid does not flow out from the cylinder (21), but rather the expansion beam (20) fulfills the function of shoring up sand guards by expanding longitudinally.

Figure 2:
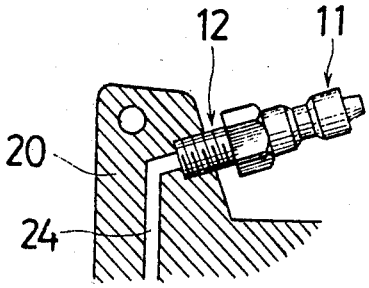
FIG. 2 is a partly enlarged view in partial cross-section of FIG. 1.

As seen in FIGS. 1 and 2, the plug (11) is provided projecting outside the pad (20), as a result of which there is the possibility of the plug (11) being damaged owing to a blow by a falling rock or other projections with the result that the non-return valve within the plug becomes unable to fulfill its function. In certain circumstances, the plug (11) becomes broken and lost together with the connecting part of the nipple (12) to the plug (11).

Figure 3:
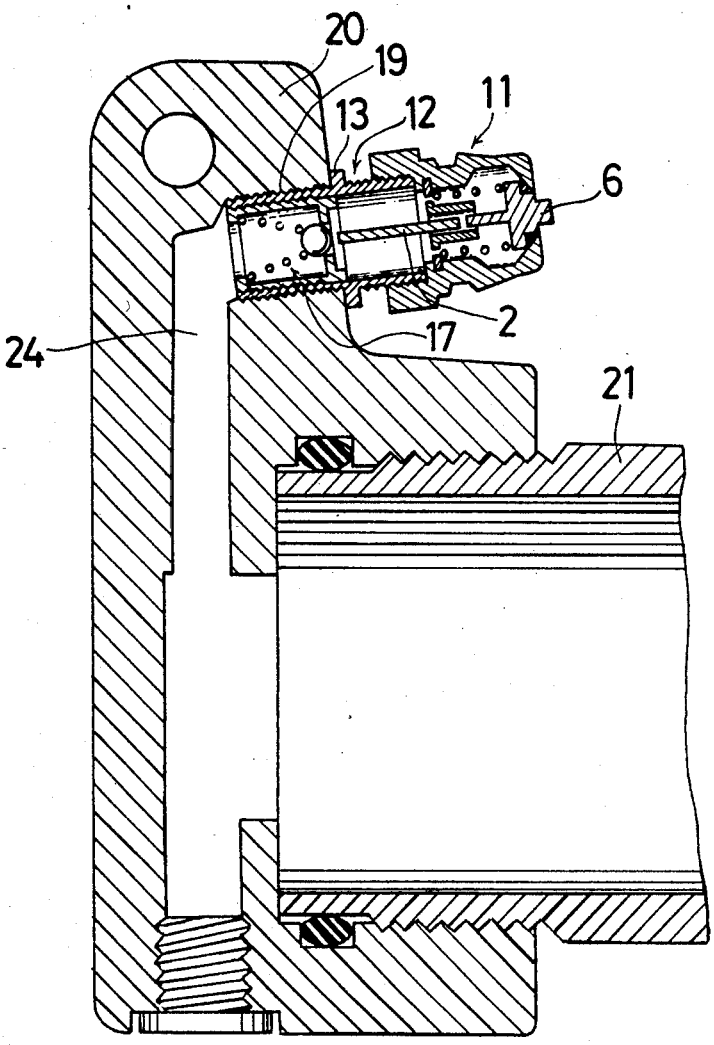
FIG. 3 is a total cross-sectional view of an example of the present invention.
Figure 4:
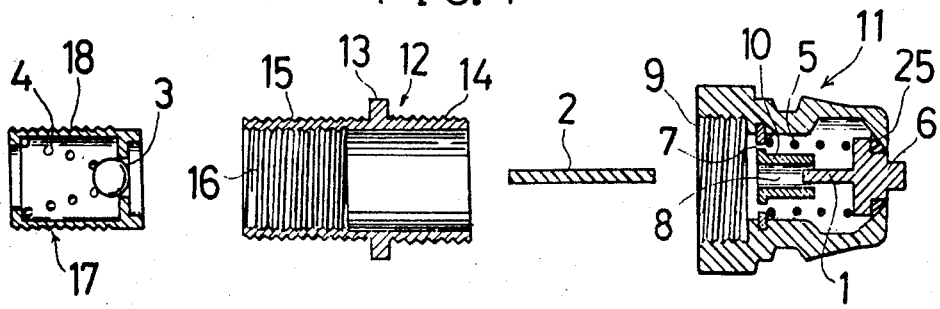
FIG. 4 is an exploded view in cross-section of the members shown in the plug of FIG. 3.
Figure 5:
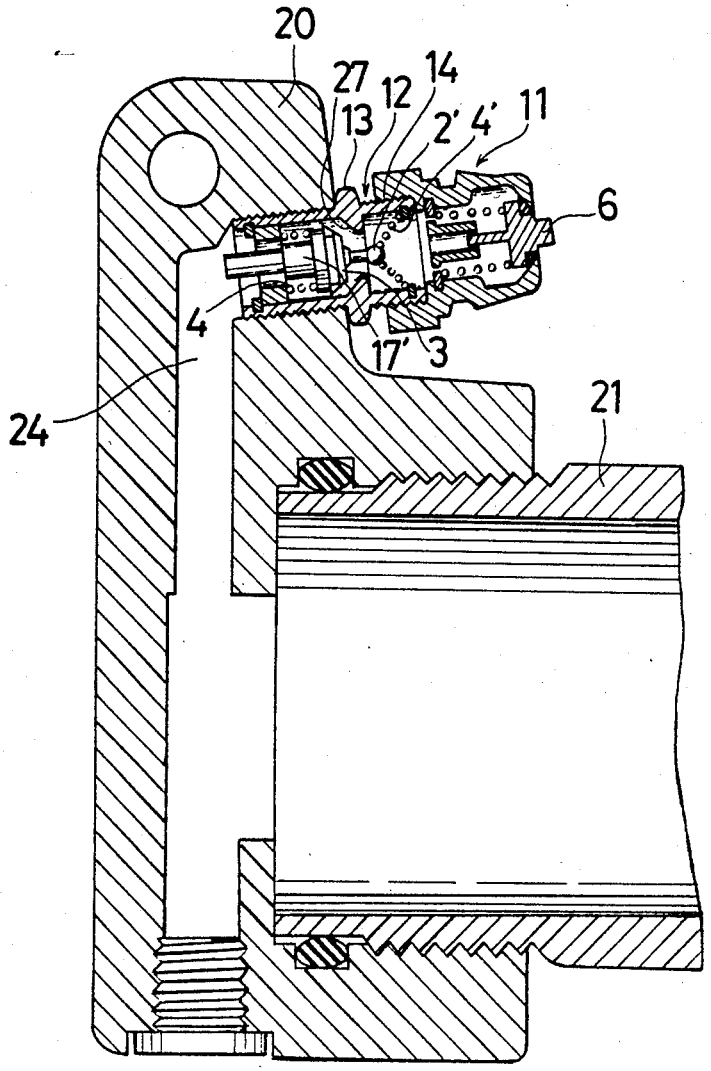
FIG. 5 is a cross-sectional view of another example of the present invention.
Figure 6:
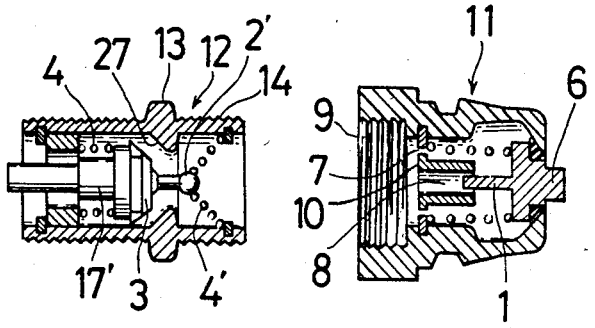
FIG. 6 is an exploded view in cross-section of the members shown in the plug of FIG. 5.

For all that, as shown in FIGS. 3 and 4, or in FIGS. 5 and 6, the invention is provided with a second non-return valve (17) within the nipple (12) and inside the connecting part thereof to the pad (20), wherefore the liquid flows out from the cylinder (21) even if the plug (11) is broken and lost together with the connecting part of the nipple (12) to the plug (11).

Hereinafter, description will be further made with reference to FIGS. 3 to 6. FIGS. 3 and 4 show a first example of the invention, while FIGS. 5 and 6 show a second example thereof.

FIG. 3 shows a section of the pad (20) and the members contingent thereto. FIG. 4 shows a section of the plug (11), the nipple (12), the second non-return valve (17), and a contacting bar (2), all of which are attached to the pad (20) and are shown in an exploded state. Referring to FIG. 4, the plug (11) is provided with a valve (6) having a shaft (1) and also with a central member (10) having a hole (8) for guiding the shaft (1) therethrough and a plurality of openings (7) for allowing the hydraulic liquid to pass through. The nipple (12) is made as a cylindrical body which has a flange (13) contouring a hexagon. The outer circumferential face of the connecting part of the cylindrical body to the plug (11) is provided with external threads (14) which are screwed into internal threads (9) of the plug (11). The second non-return valve (17) consists of a body having external threads (18) which are screwed into internal threads (16) made on the inner circumferential face of the part for connecting the nipple (12) to the pad (20). A ball valve (3) is arranged inside the second non-return valve (17), and a compression spring (4) pushes the ball valve (4) only in one direction. The contacting bar (2) is so arranged that its one end part is inserted slidably into the hole (8) of the central member (10) of the plug (11).

These elements mentioned above are assembled and built into the pad (20), as shown in FIG. 3. As shown in FIG. 4 ball valve (3) within the second non-return valve (17) is compressed by the compression spring (4) in the same direction as the valve (6) of the plug (11). When the contacting bar (2) is made to shift when the valve (6) is opened to the left, it works at the same time to open the ball valve (3) also to the left.

Incidentally, there is disclosed here that the second non-return valve (17) is to be screwed into the nipple (12), but it does not matter if the second non-return valve (17) and the nipple (12) are integrated in one body by welding, or if the nipple (12) itself is so designed as to have a spring seat which holds a valve seat for the ball valve (3) and further holds one end of the compression spring (4). In any case, it will do if such a non-return valve (17) is provided in the interior of the connecting part thereof to the pad (20) when viewed inwardly from the flange (13). On the other hand, as the nipple (12), there is illustrated one which is screwed into the plug (11), but it is acceptable that they are integrated in a single body by welding. In this case, however, it is preferable to consider what happens when there occurs a breakage at the right side part of the invention when viewed from the flange (13), that is, at the connecting part of the nipple (12) to the plug (11), when a large impulsive force is applied to the plug (11). There is further illustrated the contacting bar (2) as the element which makes the non-return valve of the plug (11) interlock with the second non-return valve, (17), the contacting bar (2) may be of any construction as long as it can move the ball valve (3) from its valve seat against the compression spring (4) while impinging upon the ball valve (3) when the non-return valve of the plug (11) opens. Also the contacting bar (2) must be able to separate from the ball valve (3) when the plug (11) is broken.

Description will be now directed to the second example of this invention with reference to FIGS. 5 and 6. FIG. 5 shows the section of the pad (20) and the members contingent thereto, and FIG. 6 shows the section of the plug (11), the nipple (12), and the second non-return valve (17') integrated in a body with the nipple (12), which are all to be attached to the pad (20) and which are shown in an exploded view. Referring to FIG. 6, the plug (11) is provided with a valve (6) having the shaft (1), and the central member (10) having the hole (8) for guiding the shaft (1) and also a plurality of openings (7) for allowing the hydraulic liquid to pass through. The nipple (12) is made up of a cylindrical body which has a flange (13) of a hexagonal contour. The outer circumferential face of the connecting part of the cylindrical body to the plug (11) is provided with the external threads (14) which are screwed into the internal threads (9) of the plug (11). The second non-return valve (17') consists of a valve body (3) provided within the connecting part of the nipple (12) to the pad (20) and a compression spring (4) for compressing the valve body (3) in one direction. The valve body (3) cooperates with a valve seat (27) being provided inside the nipple (12). The valve body (3) has a head (2') which projects a little to the side of the connecting part of the nipple (12) to the plug (11). On this head (2'), force is exerted by a restraining device (4'). The restraining device (4') is provided within the connecting part of the nipple (12) to the plug (11), and usually holds the second non-return valve (17') in the open position.

These members are assembled and equipped into the pad (20), as shown in FIG. 5. The second valve body (3) of the non-return valve (17') is compressed by the compression spring (4) in the same direction as the valve (6) of the plug (11), and at this time it is held in the open position by the counting restraining device (4'). But when the counting restraining device (4') is broken, then the second non-return valve (17') is closed.

Incidentally, there is disclosed here that the second non-return valve (17') is constructed integrally with the nipple (12), but it may be formed so as to be able to be loaded detachably on the nipple (12). The restraining device (4') can be also detachably loaded on the nipple (12), or it may be integrated with the nipple (12). It is to be noted that the fitting of the restraining device (4') on the nipple (12) must be done within the connecting part of the nipple (12) to the plug (11) as remote as possible from the valve seat (27), and further that such a kind of second non-return valve (17') must be provided in the interior of the side of the connecting part to the pad (20) when viewed from the flange (13). As the nipple (12), there is here illustrated one which is screwed in the plug (11), but it may be integrated with the plug (11) by welding. But in this case it is desirable that the right side part when viewed from the flange (13), that is, the connecting part of the nipple (12) to the plug (11) can be broken when a large impulsive force is applied to the plug (11). On the other hand, there is also illustrated the valve seat (3) with a projecting head (2'), whereby the second non-return valve (17') is held in the open position, but it does not matter if a projection is attached to the restraining device (4'), and if this projection directly contacts the valve body (3). In either case, any construction will do if the restraining device separates from the valve body (3) when the plug (11) is broken.

In such a construction as shown in FIGS. 3 and 4, the second non-return valve (17) is never broken even if the plug (11) is broken or damaged owing to a falling stone and the like because the second non-return valve (17) is provided within the limits of the pad (20), thereby preventing the hydraulic liquid from flowing out of the pad (20). Further, even when the seal ring (25) shown in FIG. 4 or some sealing material of the non-return valve of the plug (11) deteriorates and becomes unable to work, the second non-return valve (17) still works and prevents the outflow or leakage of the hydraulic liquid. Moreover, since the non-return valve of the plug (11)

interlocks with the second non-return valve (17), when the socket is loaded in the plug (11), then the second non-return valve (17) is also opened, enabling the hydraulic liquid to flow out at will. On the other hand, because the second non-return valve (17) is provided within the nipple (12), it is possible to construct the interlocking device by the use of a single piece of contacting bar (2).

Figure 7:
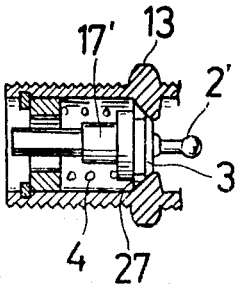
FIG. 7 is a cross-sectional view of a part showing a state where the restraining device has been released and the second non-return valve is put into action.

In such a construction as shown in FIGS. 5 and 6, since the second non-return valve (17') usually lies in the open position, it is possible to make the hydraulic liquid flow in and out at will when the socket and the like is loaded on the plug (11). As for the restraining device, it can be constructed using a simple material such as a conical spring because the second non-return valve (17') is provided within the nipple (12) and has a projecting head (2'). When the plug (11) and the connecting part of the nipple (12) to the plug (11) are broken and lost, the projecting head (2') of the second non-return valve (17') projects out of the nipple (12), as shown in FIG. 7, whereby the second non-return valve (17') is quickly actuated. Accordingly, the projecting head (2') is pushed when intending to expand or contract the expansion beam.

The foregoing preferred embodiments are considered illustrative only. Numerous other modifications and changes will occur to those skilled in the pertinent art. Consequently, the disclosed invention is not limited to the exact constructions and operations shown and described above.

What is claimed is:

1. An expansion beam for shoring up sand guards, comprising:

an expansible and contractible piston and cylinder-type expansion device being actuated by pressure exerted by hydraulic liquid;

pad means, attached to opposite ends of the expansion device, for contacting the sand guards;

a plug having two ends and being connected into one of the pad means;

a first non-return valve means, arranged at one end of the two ends of the plug, for allowing the hydraulic liquid to pass from outside of the plug into the plug, said one end being exposed farther away from the pad means than the other of the two ends of the plug;

nipple means, interposed between the plug and the pad means, for communicating the plug with the pad means;

a second non-return valve means, arranged in a part of the nipple means inside of the pad means, for allowing the hydraulic liquid to pass from the plug to the nipple means;

passage means, arranged in the pad means, for allowing the hydraulic liquid to pass from the nipple means to the expansion device; and means, provided between the first and the second non-return valve means, for contacting both non-return valve means upon actuation of the first non-return means by passage of the hydraulic liquid from outside of the plug into the plug;

whereby operation of the expansion beam continues even if the plug, the first non-return valve means, and part of the nipple means outside of the pad means are broken off.

2. The expansion beam as set forth in claim 1, wherein:

said second non-return valve means is detachably arranged in the part of the nipple means inside of the pad means.

3. The expansion beam as set forth in claim 1, wherein:

said second non-return valve means is integrally arranged in the part of the nipple means inside of the pad means.

4. The expansion beam as set forth in claim 2, wherein:

said plug is made integral with the nipple means.

5. The expansion beam as set forth in claim 3, wherein:

said plug is made integral with the nipple means.

6. The expansion beam as set forth in claim 1, wherein:

said contacting means is a single bar means for bridging the distance between the first and second non-return valve means.

7. An expansion beam for shoring up sand guards, comprising:

an expansible and contractible piston and cylinder-type expansion device being actuated by pressure exerted by hydraulic liquid;

pad means, attached to opposite ends of the expansion device, for contacting the sand guards;

a plug having two ends and being connected into one of the pad means;

a first non-return valve means, arranged at one end of the two ends of the plug, for allowing the hydraulic liquid to pass from outside of the plug into the plug, said one end being exposed farther away from the pad means than the other of the two ends of the plug;

nipple means, interposed between the plug and the pad means, for communicating the plug with the pad means;

a second non-return valve means, arranged in a part of the nipple means inside the pad means, for allowing the hydraulic liquid to pass from the plug to the nipple means;

passage means, arranged in the pad means, for allowing the hydraulic liquid to pass from the nipple means to the expansion device; and means, provided in the part of the nipple means inside of the pad means, for keeping the second non-return valve means open under normal conditions;

whereby operation of the expansion beam continues even if the plug, the first non-return valve means, and part of the nipple means outside of the pad means are broken off.

8. The expansion beam as set forth in claim 7, wherein:

said second non-return valve means is detachably arranged in the part of the nipple means inside of the pad means.

9. The expansion beam as set forth in claim 7, wherein:

said second non-return valve means is integrally arranged in the part of the nipple means inside of the pad means.

10. The expansion beam as set forth in claim 7, wherein:

said second non-return valve means has a head means, arranged in a part of the nipple means facing the plug, for projecting toward the plug.

11. The expansion beam as set forth in claim 10, wherein:

said second non-return valve means is integrally arranged in the part of the nipple means inside of the pad means.

12. The expansion beam as set forth in claim 10, wherein:

said keeping means is a conical spring having one end restraining the head means of the second non-return valve means.

* * * * *